United States Patent [19]

Platter

[11] 4,035,853

[45] July 19, 1977

[54] MATTRESS CONSTRUCTION FOR USE IN HOSPITALS AND THE LIKE

[76] Inventor: Fenton H. Platter, 609 Elwood St., Cumberland, Md. 21502

[21] Appl. No.: 665,183

[22] Filed: Mar. 9, 1976

[51] Int. Cl.[2] ..... A47C 27/22; A61G 7/02

[52] U.S. Cl. ..... 5/91; 5/361 R; 5/352

[58] Field of Search ..... 5/345, 351, 91, 361, 5/365, 352, 357

[56] References Cited

U.S. PATENT DOCUMENTS

| | | | |
|---|---|---|---|
| 7,429 | 6/1950 | Ressegine | 5/352 |
| 1,446,290 | 2/1923 | Dessau | 5/345 R |
| 2,853,399 | 9/1958 | Shoults | 5/345 R |
| 3,833,945 | 9/1974 | Moody | 5/91 X |

*Primary Examiner*—Casmir A. Nunberg
*Attorney, Agent, or Firm*—Larson, Taylor and Hinds

[57] ABSTRACT

A mattress construction is provided which comprises a plurality of individual layers of a foamed material such as form rubber separated by intermediate separator layers of another material, and a base layer formed by an assembly of alternatively disposed slats and dowels. The slats and dowels extend transversely of the mattress construction and are connected to each other by suitable cording to form a flexible assembly. A bed pan plug is provided in one side of the mattress construction.

7 Claims, 5 Drawing Figures

FIG. 1
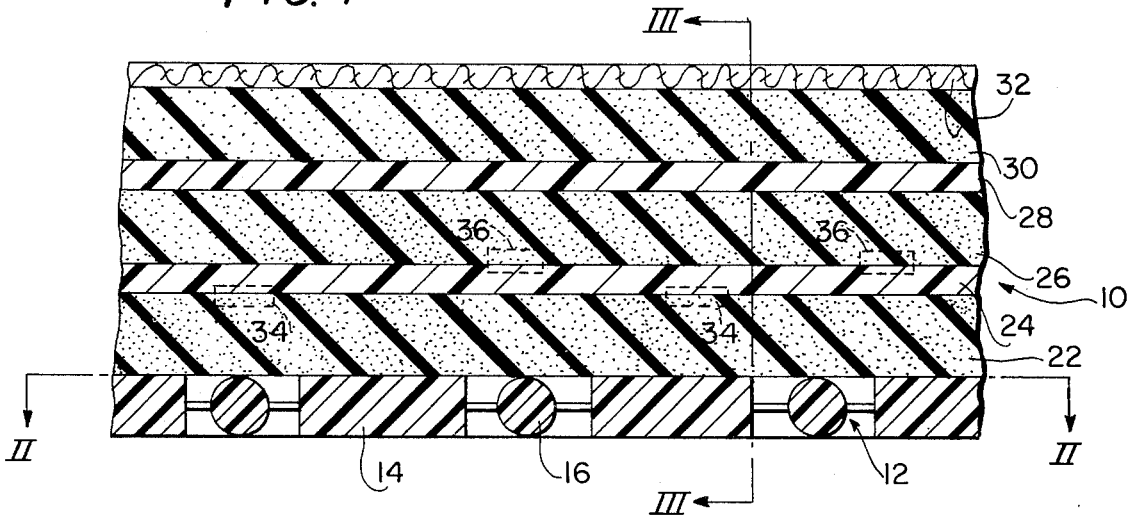
FIG. 2
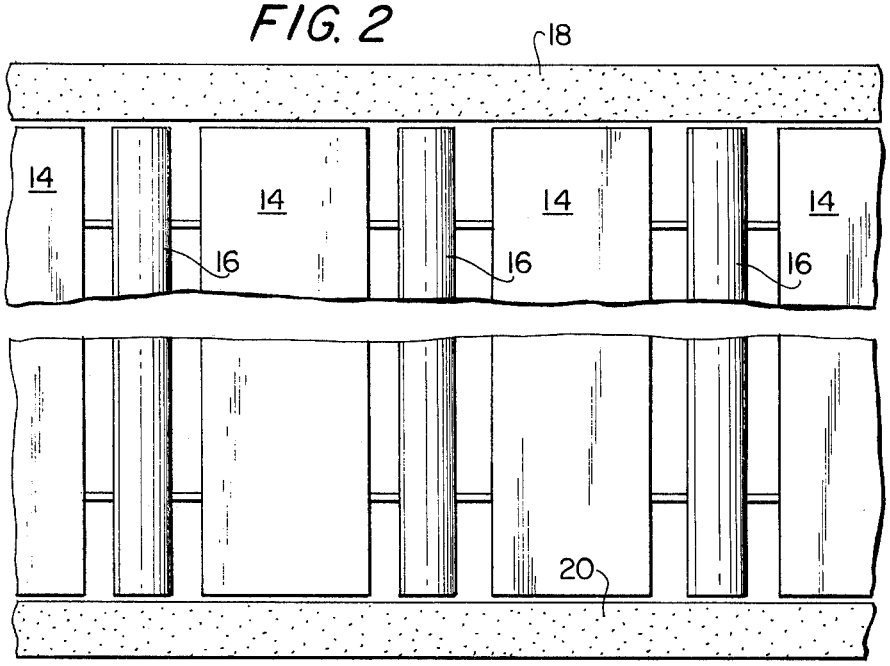
FIG. 3
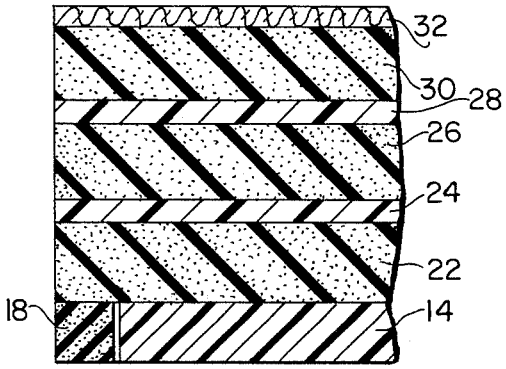
FIG. 5
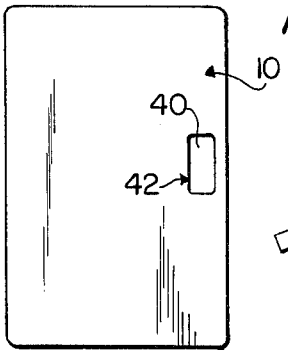
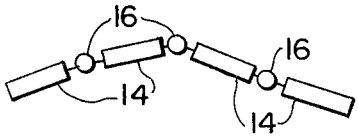
FIG. 4

MATTRESS CONSTRUCTION FOR USE IN HOSPITALS AND THE LIKE

FIELD OF THE INVENTION

The present invention relates to an improved mattress construction particularly adapted for use in hospitals and the like.

BACKGROUND OF THE INVENTION

Hospital mattresses are generally unsatisfactory, particularly where the patient using the mattress is bed-ridden for prolonged periods. Such mattresses are many times uncomfortable and serve in preventing the patient from relaxing. Conventional mattresses exert pressures on the patient which cause bed sores, and are prone to bulges, caused by folding, as, for example, when the head of the bed is raised. Thus, a need exists for a mattress which overcomes the various problems referred to and provides gentle therapeutic support for the user.

Examples of mattresses which are of possible interest here include those disclosed in U.S. Pat. Nos. 3,249,952 (Janapol); 2,853,399 (Shoults) and 1,446,290 (Nessau), although this listing is obviously not, nor is it intended to be, exhaustive.

SUMMARY OF THE INVENTION

In accordance with the invention, a mattress construction is provided which overcomes the problems of prior art mattresses discussed above. The mattress of the invention is particularly adapted for use in hospitals or rest homes but can, of course, be put to more general use. The mattress construction of the invention provides firm, gentle support which helps a patient to be comfortable and hence more relaxed, thereby contributing to the patient's recovery. Among other advantages, the mattress construction lessens pressures that cause bed sores and eliminates fold bulges which are normally produced when one part of the bed is raised or lowered with respect to another.

According to a preferred embodiment thereof, the mattress construction of the invention comprises a plurality of individual layers of a foamed material, such as foam rubber, which are separated from one another by intermediate layers of reduced thickness, and a base layer comprising a flexible assembly of transversely extending support members. The support members comprise members having a flat upper surface, preferably slats, and members having a rounded upper surface, preferably dowels, which are alternatively disposed and which are spaced apart, but joined together by suitable cording or the like, to form a flexible mat.

The rounded dowels provide for a smoothing out of the sharpness of the angles which would be provided by the slats acting along, i.e., a more gentle line of curvature to match that of the body of the person lying on the mattress. These dowels also increase the wear life of the other layers and contribute to the delicate flexing provided by the mattress, which is designed to be therapeutic to the body during breathing and other body movements. The independent foam rubber layers enable independent bending or flexure which, for all intents and purposes, eliminates the problem of fold bulge referred to above.

Other features and advantages of the invention will be set forth in, or apparent from, the detailed description of a preferred embodiment found hereinbelow.

BRIEF DESCRIPTION OF THE DRAWINGS

FIG. 1 is a fragmentary, longitudinal cross-sectional view of a mattress construction in accordance with the invention;

FIG. 2 is a cross-sectional view taken generally along line II—II of FIG. 1, illustrating the slat and dowel assembly of the invention;

FIG. 3 is a fragmentary, transverse cross-sectional view taken generally along line III—III of FIG. 2;

FIG. 4 is a schematic cross-sectional view of the slat and dowel assembly of the invention, illustrating the bending or flexure provided thereby; and FIG. 5 is a plan view of a mattress construction including a bed pan plug, in accordance with a further aspect of the invention.

DESCRIPTION OF THE PREFERRED EMBODIMENTS

Referring to the drawings, and, in particular, to FIGS. 1 and 2, a mattress construction in accordance with the invention is shown. The mattress, which is generally denoted 10, includes a base or bottom layer 12 formed by alternately disposed flat members or slats 14 and rounded members or dowels 16. As can best be seen in FIG. 2, the slats 14 and dowels 16, which extend transverse to the mattress proper, are joined together by two lengths of cord 18 to form a flexible mat. As is also shown in FIG. 2 (and FIG. 3) the ends of slat 14 and dowel 16 extend to points adjacent to, but spaced from, the mattress proper. Two strips of filler material 18 and 20 extend along the opposite edges of slats 14 and dowels 16 to complete the bottom layer 12 and prevent exposure of the ends of the slats and dowels. Similar strips (not shown) are provided at the head and foot of the mattress.

A layer of foam rubber or a like material, denoted 22, is secured to the layer 12 formed by slats 14, dowels 16 and strips 18,20. An intermediate layer of nylon, denoted 24, is secured to foam rubber layer 22. Similarly, as shown in FIGS. 2 and 3, two further layers of foam rubber, denoted 26 and 30, are provided which are separated by a further intermediate layer 28, the bottom one of these, viz., layer 26 being secured to intermediate layer 24. Finally, a mattress cover 32 is secured to upper foam rubber layer 30.

A specific example of a preferred manner of constructing the mattress of FIGS. 1 to 3 will now be considered. It is to be understood that the following is merely offered as a specific example and is not intended as limiting. The slats 14 used in this specific example are fabricated of wood or hard plastic and are ½-inch thick and 2½-inches wide. The dowels 16 are fabricated of similar materials and are ½-inch in diameter. Both are drilled with a 5/32-inch drill at central locations in the widths thereof spaces 6-inches in from each end. The slats 14 and dowels 16 are assembled using two ⅛-inch nylon woven cords to maintain alignment.

The bottom foam layer 22, like foam layers 26 and 30, is fabricated on one inch thick foam rubber, and is secured to base layer 12 by adhesive, layer 22 being secured to all slats for the first 2 feet from the head end and the last 18 inches from the foot end and to every other slat in between. The lateral edges of layer 22 extend over the edges of layer 12 by 2 inches on each side and at each end.

The first intermediate layer or sheet 24 covers the entire surface of foam rubber layer 22 and is secured thereto each 8 inches with a transverse line of adhesive. Layer 24, like layer 28, is fabricated of a nylon or similar material. Foam layer 26 is secured to nylon layer 24 using lines of adhesive which are spaced apart every 8 inches and are offset from the lines of adhesive joining sheet 24 to layer 26. This offsetting is indicated schematically in FIG. 1 by the offset lines of adhesive 32 and 34 shown as dashed line rectangles. Layers 30 and 28 are joined together and to adjacent layers in a similar manner although the upper surface of foam layer 30 is joined to upper layer 32 with lines of adhesive spaced every 2 inches. The side strips 18 and 20 (and the end strips corresponding thereto) are each constructed of a ½-inch by 2-inch piece of foam rubber which is of a firmer consistency than that forming foam layers 22, 26 and 30. The filler strips are attached to adjacent surfaces by adhesive. Finally, a water proof mattress cover (not shown), complete with breathers, completes the mattress.

As noted hereinabove, the provision of a mat or assembly of slats and dowels has a number of advantages, particularly in accommodating body forms of varying shapes and contours. A pronounced curve between the waist and hip could produce a relatively sharp angle between the slats if only slats were used. The dowels 16 provide rounding of this angle, as is indicated by curved line 40 in FIG. 4, thereby increasing the comfort of the person lying on the mattress. The dowels 16 also increase the wearability of the foam rubber layer 22 in contact therewith and, to a lesser extent, to the wearability of the other layers. Further, the dowels 16 contribute to the delicate flexing provided by the mattress which is intended to act therapeutically on the body during breathing or other movement.

The separate foam rubber layers 22, 26 and 30 allow for independent bending, which practically eliminates fold bulge. More generally, the mattress construction readily adapts to the shape of the body while still providing firm yet comfortable support.

In accordance with a further feature of the invention illustrated in FIG. 5, a removable bed pan plug 40 is included on one side of the mattress. In this location, plug 40 is convenient to remove yet readily accessible for use by, for example, elderly patients. The plug 40 fits in a suitable recess 42 in mattress 10 and is covered with a suitable plastic to aid in maintaining sanitation. The fact that plug 40 is located in the side prevents interference with the centrally located slat and dowel assembly although minor modifications can be made in the mattress construction if desired.

Although the invention has been described relative to examplary embodiments thereof, it will be understood that other variations and modifications can be effected in these embodiments without departing from the scope and spirit of the invention.

I claim:

1. A mattress construction for hospitals and the like comprising a plurality of separate layers of a foam material and a further layer comprising a plurality of transversely extending, alternately disposed flat members and rounded members, and means for joining said flat members and rounded members to form a flexible assembly, said flat members including a flat upper surface and said rounded members including a rounded upper surface, said flat members comprising slats and said rounded members comprising dowels, said construction including at least three separate layers of a foam material, said separate layers being separated by intermediate layers of reduced thickness, said further layer, in use, being located beneath said separate layers and being secured to the bottommost one of said three separate layers by an adhesive.

2. A mattress construction as claimed in claim 1 wherein said further layer comprises, in use, the bottom layer of the mattress construction.

3. A mattress construction as claimed in claim 1 wherein said intermediate layers are joined to said layers of a foamed material by transverse, spaced lines of adhesive, the lines of adhesive joining adjacent layers being offset from one another.

4. A mattress construction as claimed in claim 1 further comprising a quilted cover layer.

5. A mattress construction as claimed in claim 1 wherein said mattress includes a recess for a bed pan at one side thereof and a plug for closing off said recess.

6. A mattress construction as claimed in claim 1 wherein said flexible assembly of slats and dowels terminate adjacent to, but spaced from, the edges of the mattress construction, said mattress construction further including strips located between the edges thereof and the extremities of said flexible assembly.

7. A mattress construction as claimed in claim 1 wherein said foamed layers are fabricated of foamed rubber and said intermediate layers are fabricated of a nylon material.

* * * * *